US006215234B1

(12) United States Patent
Abe et al.

(10) Patent No.: US 6,215,234 B1
(45) Date of Patent: Apr. 10, 2001

(54) SPARK PLUG HAVING SPECIFIED SPARK GAP DIMENSIONAL RELATIONSHIPS

(75) Inventors: Nobuo Abe, Yokkaichi; Yasushi Kawashima, Inabe-gun, both of (JP)

(73) Assignee: Denso Corporation (JP)

( * ) Notice: Subject to any disclaimer, the term of this patent is extended or adjusted under 35 U.S.C. 154(b) by 0 days.

(21) Appl. No.: 09/208,272

(22) Filed: Dec. 9, 1998

(30) Foreign Application Priority Data

| | | |
|---|---|---|
| Dec. 26, 1997 | (JP) | 9-369155 |
| Dec. 27, 1997 | (JP) | 9-369059 |
| Nov. 11, 1998 | (JP) | 10-320863 |
| Nov. 11, 1998 | (JP) | 10-320864 |

(51) Int. Cl.[7] ..... H01T 13/20; H01T 13/22; H01T 13/34; H01T 13/36; H01T 21/02

(52) U.S. Cl. ..... 313/141; 313/144; 123/169 EL; 445/7

(58) Field of Search ..... 313/118, 140, 313/141, 142, 144; 123/169 EL, 169 EA; 445/7, 46, 49, 50–51

(56) References Cited

U.S. PATENT DOCUMENTS

| | | | | |
|---|---|---|---|---|
| 3,970,885 | | 7/1976 | Kasima . | |
| 4,845,400 | * | 7/1989 | Takamura et al. | 313/141 X |
| 5,202,601 | | 4/1993 | Takamura et al. . | |
| 5,233,378 | | 8/1993 | Hosokawa et al. . | |
| 5,373,214 | * | 12/1994 | McCready | 313/141 X |
| 5,514,929 | | 5/1996 | Kawamura . | |
| 5,998,912 | * | 12/1999 | Schwab | 313/141 X |
| 6,046,532 | * | 4/2000 | Matsutani et al. | 313/141 |

FOREIGN PATENT DOCUMENTS

B2 59-33949 8/1984 (JP) .

* cited by examiner

*Primary Examiner*—Michael H. Day
*Assistant Examiner*—Mack Haynes
(74) *Attorney, Agent, or Firm*—Nixon & Vanderhye PC

(57) ABSTRACT

A spark plug defines a spark gap G in a range of 0.2 mm≦G<0.4 mm, between a noble metal chip disposed on a central electrode and an earth electrode. The noble metal chip has a groove portion facing the earth electrode so that a space, which is larger than a sphere having a diameter equal to or larger than 0.4 mm, is provided in the spark gap G. As a result, a flame core having a diameter equal to or larger than 0.4 mm can be held in the space not to be quenched, resulting in high ignition property of the spark plug.

29 Claims, 9 Drawing Sheets

FIG. 1
PRIOR ART
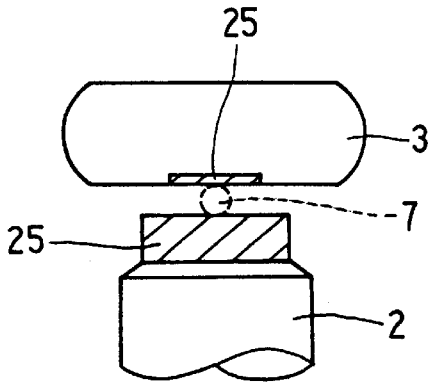
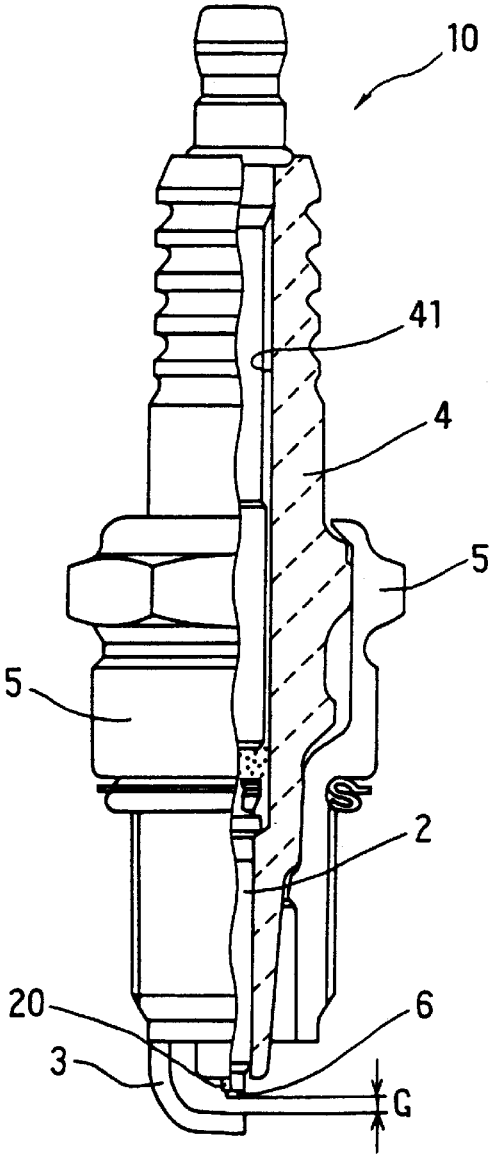
FIG. 2

6
61
619
W
H
VIIA
VIIB
VIIC
VIID

FIG. 16

| | THE PRESENT INVENTION | PRIOR ART |
|---|---|---|
| CRYSTAL GRAIN STRUCTURE | 69 | 98 |
| DIAMETER 1. 0 mm | 20, 6a | 20, 9 |
| EVALUATION | ○ | ○ |
| DIAMETER 1. 5 mm | 20, 6a, 8 | 20, 8, 9, 8 |
| EVALUATION | ○ | △ |
| DIAMETER 2. 0 mm | 20, 6a, 8 | 20, 9, 8, 8 |
| EVALUATION | ○ | × |

SPARK PLUG HAVING SPECIFIED SPARK GAP DIMENSIONAL RELATIONSHIPS

CROSS REFERENCE TO RELATED APPLICATIONS

This application is based upon and claims the benefit of Japanese Patent Applications No. 9-369059, filed on Dec. 27, 1997, No. 9-369155 filed on Dec. 26, 1997, No. 10-320863 filed on Nov. 11, 1998, and No. 10-320864, filed on Nov. 11, 1998, the contents of which are incorporated herein by reference.

BACKGROUND OF THE INVENTION

1. Field of the Invention

This invention relates to a spark plug for an internal combustion engine suitable for a vehicle, a cogenerator, a gas transporting pump, or the like.

2. Description of the Related Art

A large engine, which is applied to a large generator using gaseous fuel (cogenerator), a gas transporting pump, or the like, usually includes a large spark plug having, for example, a housing outer diameter of 18 mm, an insulator head portion diameter of 14 mm, a central electrode diameter of 2.5 mm, and an entire length of 115 mm. This kind of large engine is always operated without intervals. Therefore, the large spark plug for the engine is especially required to have long life in order to improve a maintenance property and in order to reduce plug exchanging cost.

It is conceivable, to secure the long life of the spark plug, that a spark gap is prevented from being enlarged during spark discharge so as not to increase a required voltage necessary for the spark discharge. Therefore, as shown in FIG. 1, discharge members 25 made of a noble metal material having favorable expendability resistance are generally disposed on respective front ends of a central electrode 2 and an earth electrode 3, thereby preventing the spark gap from being enlarged.

The discharge members 25 having large areas, however, can lowers a spark discharge ignition property. The reason is considered as follows. That is, when the discharge members 25 have large areas to have specific calorific capacities, flame cores 7 produced by the spark discharge contact the discharge members 25 and are immediately cooled down. That is, the flame cores 7 are quenched without growing, resulting in deterioration of the spark discharge ignition property.

To solve this problem, JP-A-4-242090 proposes a noble metal chip as a discharge member that has a groove on a discharge face. However, in the spark plug, because the electrical insulating propery of the spark plug is so high that sparks are not liable to be produced, it is difficult to sufficiently comply with the above-described requirements of a large engine. In addition, it is easy for cracks to develop in the the noble metal chip due to thermal stress produced by a thermal expansion difference between the noble metal chip and the central electrode, so that it is easily separated from the central electrode, shortening the spark plug life.

SUMMARY OF THE INVENTION

The present invention has been made in view of the above problems. An object of the present invention is to provide a long-life spark plug suitable for an internal combustion engine and capable of providing a low required voltage for generating sparks and a high ignition property. Another object of the present invention is to provide a long-life spark plug including a noble metal chip with high strength and toughness.

According to a first aspect of the present invention, a spark plug has, an insulator, a central electrode disposed in a through hole of the insulator, a housing, and an earth electrode fixed to the housing and facing the central electrode to define a spark gap G therebetween. The spark gap G is within a range of0.2 mm$\leqq$G<0.4 mm, and a space which is larger than a sphere having a diameter equal to or larger than 0.4 mm is provided in the spark gap G.

Therefore, the space can hold a flame core having a diameter equal to or larger than 0.4 mm not to quench the flame core, so that spark discharge is effectively performed, resulting in high ignition property. This is because the flame core which grows to have a diameter equal to or larger than 0.4 mm is not easily quenched by contacting the electrodes. Because the spark gap G is in the range of 0.2 mm$\leqq$G<0.4 mm, a required voltage for producing sparks is relatively low.

Preferably, a noble metal chip is disposed on one of the central electrode and the earth electrode to face another one of the central electrode and the earth electrode with the spark gap G therebetween. More preferably, the noble metal chip has a groove for forming the space. When the spark plug dispenses with the noble metal chip, one of the central electrode and the earth electrode can have a groove for forming the space.

According to another aspect of the present invention, a noble metal chip is bonded to one of the central electrode and the earth electrode to face another one of the central electrode and the earth electrode, and the noble metal chip includes a plurality of crystal grains having an average grain diameter N $\mu$m in an axial direction thereof and an average grain diameter K $\mu$m in a radial direction thereof. The average grain diameters N, K fulfill relationships of N>K and (N+K)2$\leqq$50 $\mu$m.

Therefore, the noble metal chip can have high strength and toughness with respect to thermal stress in the radial direction thereof which is produced by a thermal expansion difference between the noble metal chip and the electrode. As a result, cracks capable of causing separation of the noble metal chip are prevented from being produced in the noble metal chip, resulting in spark plug long-life. Even when the noble metal chip has a diameter equal to or larger than 1.5 mm not to be wasted by spark discharge, cracks and separation can be prevented from occurring to the noble metal chip due to the crystal grain structure described above.

BRIEF DESCRIPTION OF THE DRAWINGS

Other objects and features of the present invention will become more readily apparent from a better understanding of the preferred embodiments described below with reference to the following drawings.

FIG. 1 is an explanatory view showing a flame core produced in a spark gap of a conventional spark plug;

FIG. 2 is a partially cross-sectioned front view showing a spark plug in a first preferred embodiment;

FIG. 16 is a table showing crack occurrence states of noble metal chips in the fifth embodiment and crack occurrence states of conventional noble metal chips.

Figure 3:
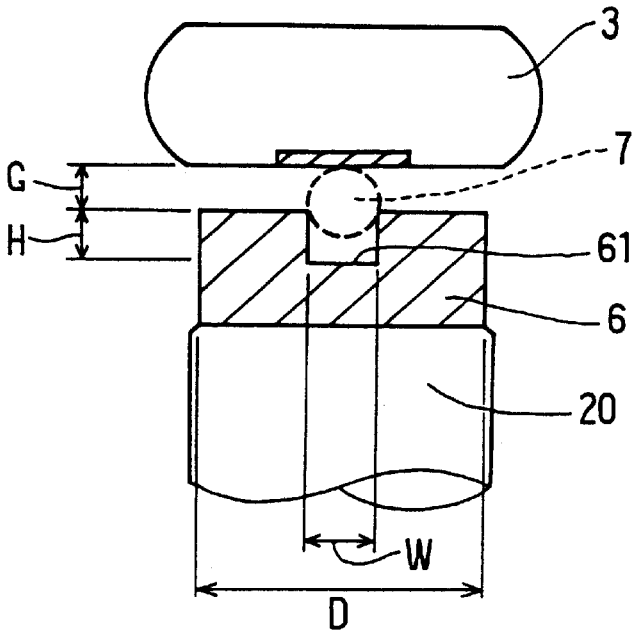
FIG. 3 is an explanatory view showing a relationship between a groove dimension of a noble metal chip and a spark gap in the first embodiment.

DETAILED DESCRIPTION OF THE PREFERRED EMBODIMENTS (First Embodiment)

A large spark plug 10 in a first preferred embodiment is applied to a large engine such as a cogenerator. Referring to FIG. 2, the spark plug 10 includes an insulator 4, a central electrode 2 held in a through hole 41 of the insulator 4, a housing 5 holding the insulator 4 therein, and an earth electrode 3 disposed on the housing 5.

Figure 4:
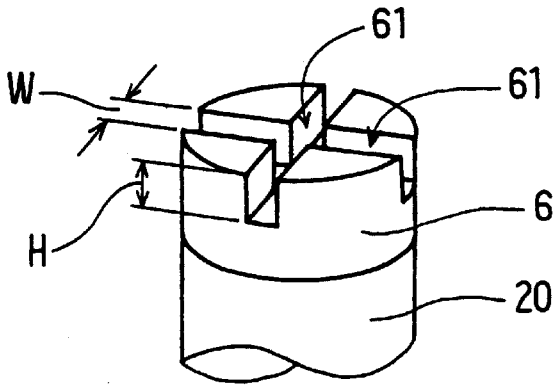
FIG. 4 is a perspective view showing the noble metal chip in the first embodiment.

A noble metal chip 6 is bonded to the central electrode 2, and spark gap G is defined between the noble metal chip 6 and the earth electrode 3. Spark gap G has a dimension of 0.2 mm≦G<0.4 mm and including a space capable of holding a sphere with a diameter of 0.4 mm. As shown in FIGS. 3 and 4, the noble metal chip 6 has a cross-shaped groove portion 61 on a surface thereof facing the earth electrode 3.

Referring again to FIGS. 3 and 4, depth H (mm) and width W (mm) of the groove portion 61, diameter D (mm) of the noble metal chip 6 and spark gap G (mm) satisfy the following relationships;

1.5 mm<D≦3.5 mm;

0.2 mm≦G<0.4 mm;

H>0.4−G; and $W>\{4\times G(0.4-G)\}^{1/2}$

The relationships are conducted as follows. That is, assuming the case where a flame core with a diameter of 0.4 mm is produced between the groove portion of the noble metal chip and the opposite electrode, the conditions which prevent the flame core from contacting the corners of the groove portion and the surface of the opposite electrode are geometrically drawn out. Accordingly, the relationships among H, W, and G are determined. Incidentally, when spark gap G is smaller than 0.2 mm, the space for holding the flame core having a 0.4 mm diameter cannot be provided. On the other hand, when spark gap G is equal to or larger than 0.4 mm, the required voltage is undesirably increased.

Next, a method of manufacturing the noble metal chip 6 in the embodiment is as follows.

First, noble metal powders including iridium (Ir) as a main component and platinum (Pt) added to Ir are mixed and are fused. Instead of Pt, Pd, Rh, Ru, or Ni may be added to Ir. Then, hot forging is carried out on the fused noble metal, thereby forming noble metal alloy having fine crystals. Next, the alloy is deformed to be a rolled wire rod by warm groove rolls while receiving compressive force in a radial direction thereof so that a diameter thereof is reduced.

Then, a heat treatment is carried out on the rolled wire rod at around recrystallization temperature. After that, the rolled wire rod is deformed by drawing using a drawing die to have a predetermined diameter necessary for the noble metal chip. Subsequently, the wire rod is cut by a cutter in the radial direction into a columnar piece. Then, the cross-shaped groove 61 is formed by a header on the columnar piece made of noble metal alloy. Thus, the noble metal chip 6 is obtained.

Next, effects in the embodiment will be explained. In the spark plug 10, the above-described relationships hold between the shape of the noble metal chip 6 and spark gap G. Therefore, the noble metal chip 6 and the earth electrode 3 can form therebetween a space which allows a flame core 7 having a diameter of 0.4 mm at most to be produced (see FIG. 3) therein. The inventors experimentally confirmed that the flame core grown to have a diameter equal to or larger than 0.4 mm cannot be easily quenched by contacting the electrode member. Therefore, the flame core 7 in this embodiment is not quenched by contacting the earth electrode 3 to be cooled. As a result, the spark plug 10 in the embodiment provide sufficient low required voltage and high ignition property. In addition, because the noble metal chip 6 is made of Ir alloy including Pt or the like, the noble metal chip 6 has high oxidization resistance at high temperature and a high melting point, resulting in long life of the spark plug 10.

Figure 5:
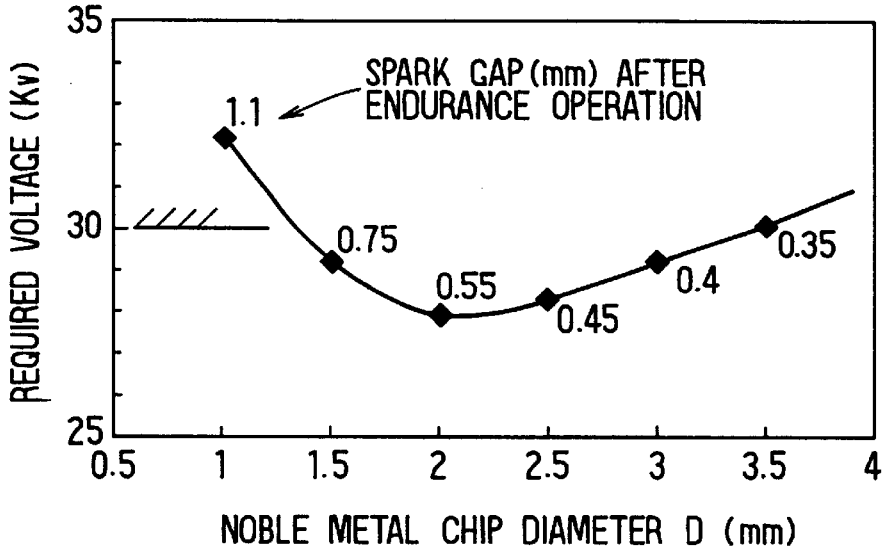
FIG. 5 is a graph showing a relationship between the diameter of the noble metal chip and the required voltage of the spark plug in the first embodiment.

Next, experimental results for confirming the above-described effects will be explained. First, as shown in FIG. 5, a relationship between diameter D of the noble metal chip 6 and the required voltage was measured. The measurement was carried out on the spark plug 10 after it was operated under the following conditions. That is, an engine which was used in the measurement had 2000 cc and 4 cycles, and was operated at an engine speed of 2000 rpm and with full load. The spark plug 10 had the same structure as described above. The noble metal chip 6 had, as shown in FIG. 4, a columnar chip with a height of 2 mm, on which the cross-shaped groove portion 61 having width W of 0.4 mm and depth H of 0.7 mm was formed. The bottom portion of the groove portion 61 had a generally U-shape in cross-section. The material of the noble metal chip 6 was Ir alloy including 10 wt % Rh. The initial spark gap G before the measurement was 0.3 mm. Under these conditions, the diameter of the noble metal chip 6 was varied from 1.0 mm to 3.5 mm by 0.5 mm.

Accordingly, as shown in FIG. 5, the required voltage is decreased as diameter D of the noble metal chip 6 is increased to approximately 2 mm, and then it is gradually increased when diameter D is increased from 2 mm. Assuming that spark gap G is not enlarged, as diameter D decreases, the spark discharge becomes to be easily produced, so that the required voltage is decreased.

However, in the measurement, the required voltage is increased when diameter D of the noble metal chip 6 is small. This is because the effect by spark gap G enlarged during the endurance operation performed before the measurement is larger than the effect by the decreased diameter of the electrode. On the other hand, when diameter D is large, spark gap G is prevented from being enlarged; however, the diameter of the electrode is increased, resulting in increased required voltage. When the required voltage exceeds 30 kV, ignition failure and the like can occur. To prevent the deficiency, it is necessary that diameter D of the noble metal chip 6 is set in a range of 1.5 mm to 3.5 mm. Incidentally, when diameter D is less than 1.5 mm, the noble metal chip is quickly wasted to shorten the life of the spark plug 10. When diameter D exceeds 3.5 mm, the required voltage is increased and simultaneously material cost is increased.

Next, an ignition limit test was carried out on the spark plug 10 having depth H and width W of the groove portion 61, diameter D of the noble metal chip 6, and spark gap G, which were varied in ranges fulfilling the above-described relationships. Specifically, first and second samples were prepared. In the first sample, H=0.1 mm, W=0.35 mm, D=1.5 mm, and G=0.3 mm. In the second sample, H=0.2 mm, W=0.4 mm, D=3.5 mm, and G=0.2 mm.

In the measurement test, the same engine as described above was used, and the engine was operated at an engine speed of 1000 rpm and with no load. Then, ignition limit air ratios of the first and second samples were measured. Here, the ignition limit air ratio indicates ratio B/A, in which A represents an amount of theoretical combustion air necessary for the combustion of fuel, and B represents an amount of supplied air. The larger ratio B/A becomes to allow lean-burn, the more the ignition property is improved. Incidentally, when the combustion was stopped in 5 minutes from the start of the operation, it was determined that the ignition did not occur. As a result of the measurement, both first and second samples exhibited favorable ignition limit air ratio of 1.4.

Next, as a comparative test 1, the same ignition limit test as described above was carried out on a spark plug including a noble metal chip which did not fulfill the relationships in the present invention. That is, in a first comparative sample, H=0.2 mm, W=0.3 mm, D=2.6 mm, and G=0.3 mm. In a second comparative sample, H=0.2 mm, W=0.35 mm, D=2.6 mm, and G=0.2 mm. The other conditions are the same as described above. Accordingly, obtained results from both first and second comparative samples were small ignition limit air ratio of 1.3.

Next, as shown in FIG, 6, in a case where diameter D1 of a conventional columnar noble metal chip and initial spark gap G were variously changed, changes in ignition limit air ratio were examined as a comparative test 2. In the test, the same engine for the test of FIG. 5 was used and the engine was operated at an engine speed of 1000 rpm and with no load. The used noble metal chip was made of Ir added with 10 wt % Rh, and did not have the groove portion thereon. Then, the ignition limit air ratios of the spark plugs including the noble metal chips described above with diameter D1 of 1.0 mm, 2.0 mm, and 3.0 mm, respectively, were measured. Likewise, when the combustion was stopped in 5 minutes from the start of operation, it was determined that the ignition did not occur.

Figure 6:
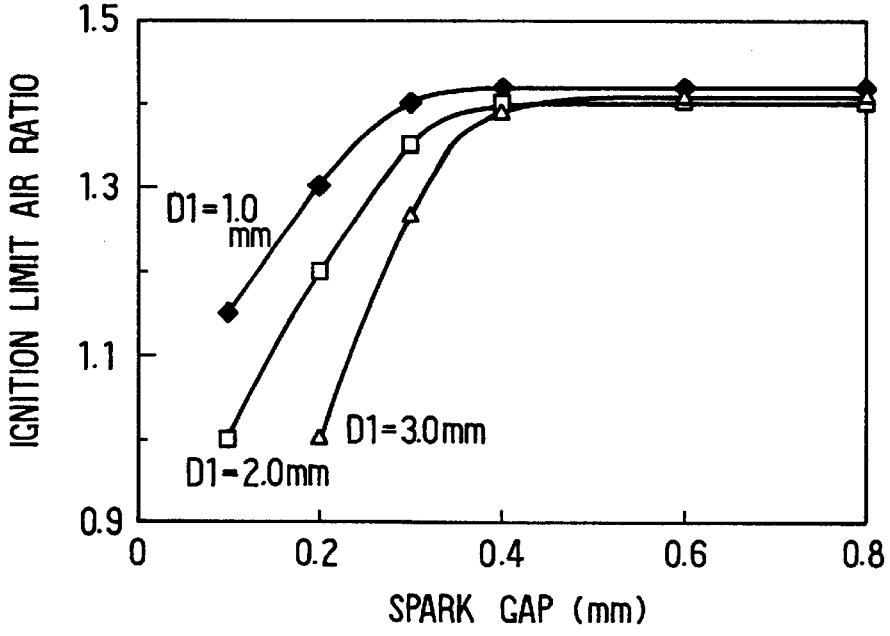
FIG. 6 is a relationship between the diameter of the noble metal chip and the ignition property.

The results are shown in FIG. 6. Accordingly, it is confirmed that when the spark gap is equal to or more than 0.4 mm, the ignition limit air ratio can be kept at a sufficient value of 1.4 without being adversely affected by the spark gap and diameter D1 of the noble metal chip.

In the first embodiment, although the noble metal chip 6 is disposed on the central electrode, the noble metal chip 6 may be disposed on the earth electrode to face the central electrode. Further, when the spark plug 10 dispenses with noble metal chip 6, the groove portion can be formed on one of the central electrode and the earth electrode so that a flame core having a diameter equal to or larger than 0.4 mm can be held in the spark gap.

(Second Embodiment)

Figures 7A, 7B, 7C, 7D:
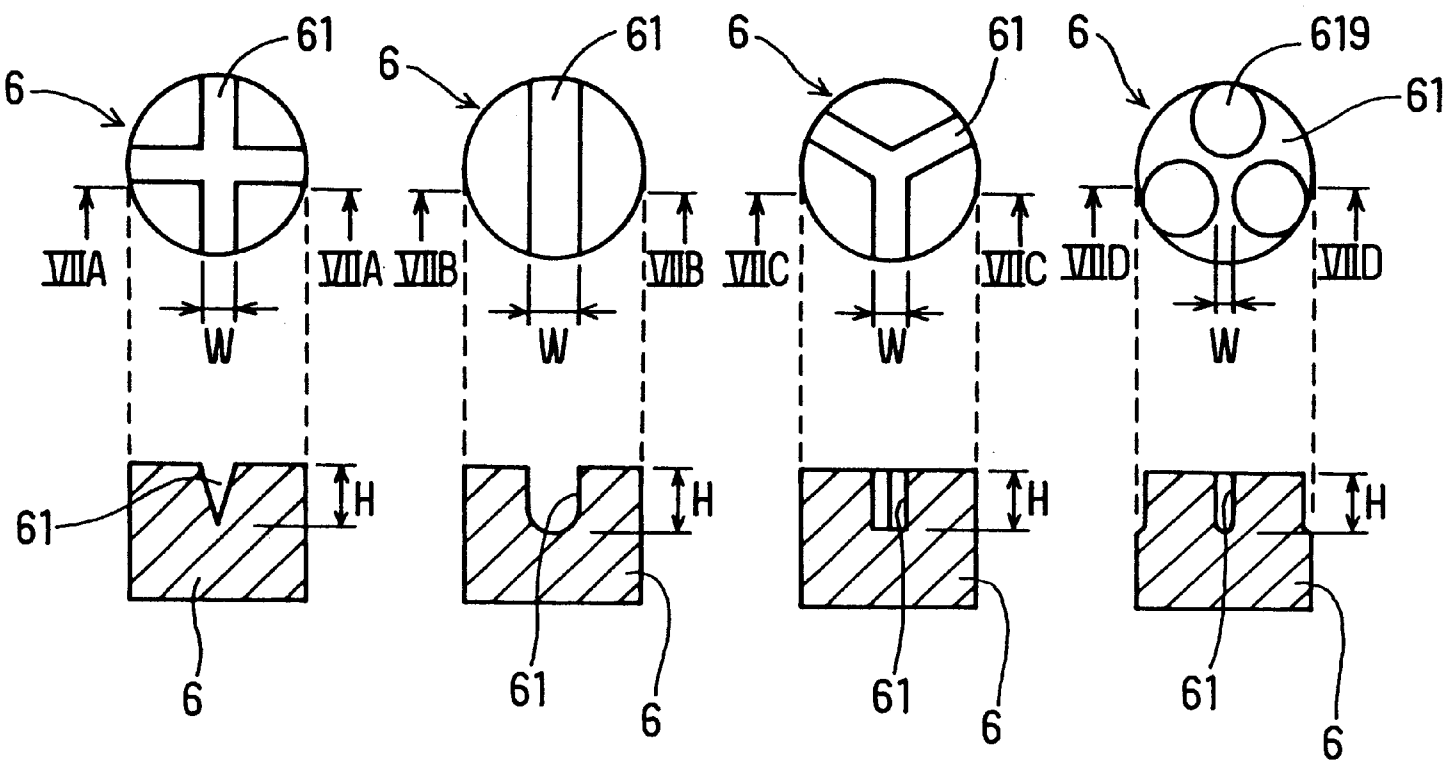
FIG. 7A is a diaphragm including a plan view showing a shape of a noble metal chip in a second preferred embodiment and a cross-sectional view taken along a $VII_A$—$VII_A$ line in the plan view.
FIG. 7B is a diaphragm including a plan view showing a shape of a noble metal chip in the second embodiment and a cross-sectional view taken along a $VII_B$—$VII_B$ line in the plan view.
FIG. 7C is a diaphragm including a plan view showing a shape of a noble metal chip in the second embodiment and a cross-sectional view taken along a $VII_C$—$VII_C$ line in the plan view.
FIG. 7D is a diaphragm including a plan view showing a shape of a noble metal chip in the second embodiment and a cross-sectional view taken along a $VII_D$—$VII_D$ line in the plan view.

In a second preferred embodiment, as shown in FIGS. 7A to 7D, the shape of the groove portion 61 of the noble metal chip 6 in the first embodiment is varied into a cross-shape, an I-shape, a Y-shape, and a curve-like shape, respectively. The cross-sectional bottom shapes of the groove portions are set to a V-like shape (7A), a U-like shape (7B), and an angular shape (7C), respectively. In FIG. 7D, three protrusions 619 are disposed to form the curved groove portion 61. The other features are the same as those in the first embodiment.

These shapes of the groove portions can effectively exhibit an edge effect such that angular portions of the groove portions face the opposite electrode to serve as staring points of sparks. As a result, the spark plugs of the second embodiment can provide low required voltage and high ignition property. Incidentally, the cross-sectional bottom shape of the groove portion can be arbitrarily selected regardless of its plan shape such as the cross-like shape. The other effects are the same as those in the first embodiment.

(Third Embodiment)

Figure 8:
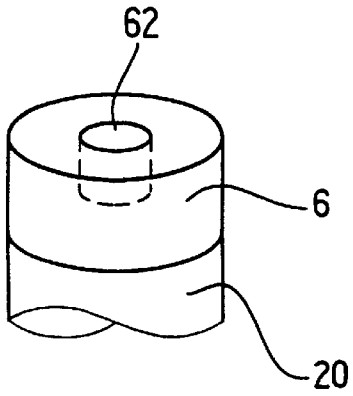
FIG. 8 is a perspective view showing a noble metal chip in a third preferred embodiment.
Figure 9A:
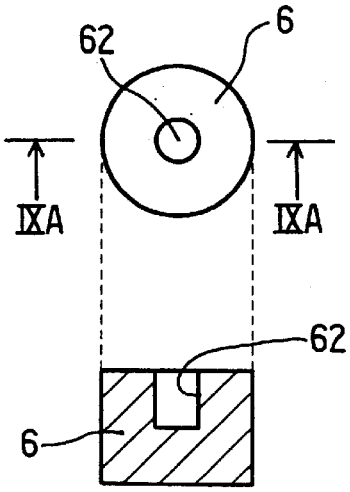
FIG. 9A is a diaphragm including a plan view showing a noble metal chip in a fourth preferred embodiment and a cross-sectional view taken along a $IX_A$—$IX_A$ line in the plan view.
Figure 9B:
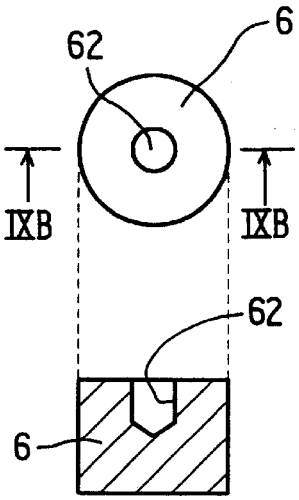
FIG. 9B is a diaphragm including a plan view showing a noble metal chip in the fourth embodiment and a cross-sectional view taken along a $IX_B$—$IX_B$ line in the plan view.
Figure 9C:
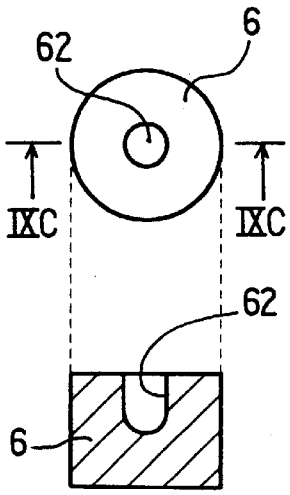
FIG. 9C is a diaphragm including a plan view showing a noble metal chip in the fourth embodiment and a cross-sectional view taken along a $IX_C$—$IX_C$ line in the plan view.

In a third preferred embodiment, as shown in FIGS. 8 and 9, a noble metal chip 6 has a concave portion 62 on the central portion thereof instead of the groove portion 61. The cross-sectional shape of the concave portion 62 is selected from a rectangular shape (FIG. 9A), a V-like shape (FIG. 9B), and a U-like shape (FIG. 9C). The other features are the same as those in the first embodiment. Accordingly, the same edge effect as in the second embodiment can be exhibited, resulting in low required voltage and high ignition property.

(Fourth Embodiment)

In a fourth preferred embodiment, a groove portion or a concave portion is provided on the central electrode instead of on the noble metal chip 6 so that spark gap G satisfies the relationship of 0.2 mm$\leqq$G<0.4 mm, and so that a space capable of holding therein a sphere having a diameter equal to or larger than 0.4 mm is provided between the central electrode and the earth electrode. The other features are the same as those in the first embodiment. Also in this case, the spark plug can provide low required voltage, high ignition property, and long life.

(Fifth Embodiment)

A spark plug in a fifth preferred embodiment has substantially the same structure as that in the first embodiment shown in FIGS. 2–4. In the fifth embodiment, the noble metal chip 6 has a plurality of crystal grains (see FIGS. 14A and 14B). When an average grain diameter in an axial direction of the noble metal chip 6 is N $\mu$m and an average grain diameter in a radial direction of the noble metal chip 6 is K $\mu$m, N and K satisfy relationships of N>K and (N+K)/23 50 $\mu$m. The columnar noble metal chip 6 has the cross-shaped groove 61 as in the first embodiment, and is welded to a electrode main material 20 of the central electrode 2.

Figure 10A:
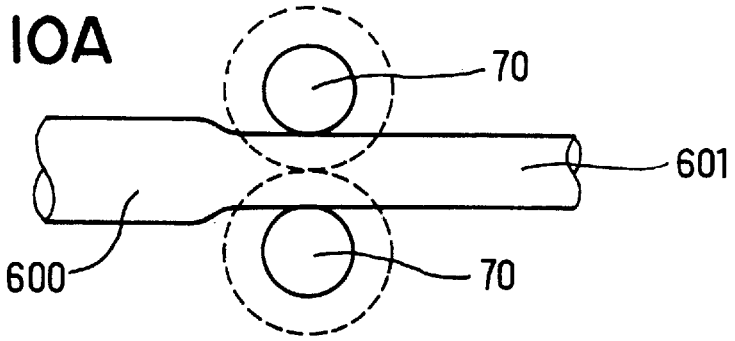
FIGS. 10A to 10C are explanatory views showing a rolling step in a method for forming a noble metal chip in a fifth preferred embodiment.
Figure 10B:
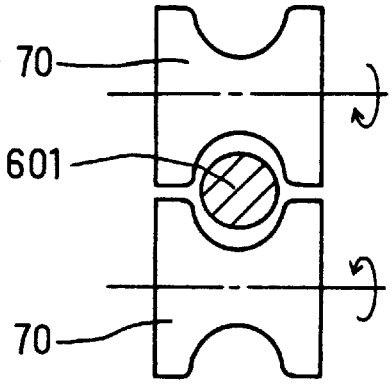
Figure 10C:
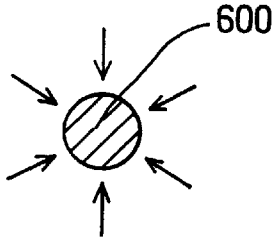

A method of manufacturing the noble metal chip 6 in the fifth embodiment is as follows. First, noble metal powders including Ir as a main component are fused after mixing, and are processed by hot forging to be a noble metal alloy 600 having fine crystals. At least one additive metal material selected from Pt, Pd, Rh, Ru, and Ni is used to form the noble metal alloy. Next, as shown in FIGS. 10A and 10B, the noble metal alloy 600 is deformed to be a rolled wire rod 601 by warm groove rolls 70 while reducing its diameter by compressive force applied in the radial direction thereof as shown in FIG. 10C.

Figure 11A:
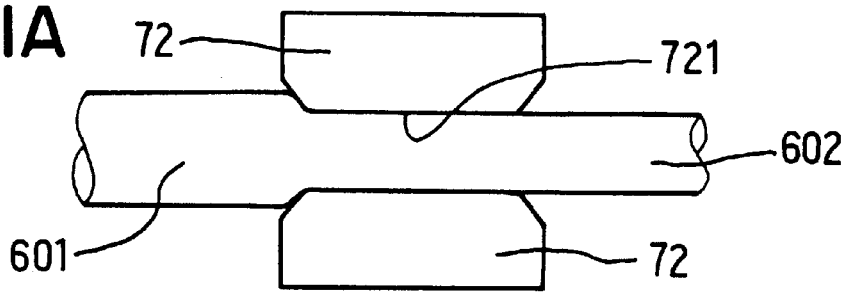
FIGS. 11A and 11B are explanatory views showing a drawing step in the method for forming the noble metal chip in the fifth embodiment.
Figure 11B:
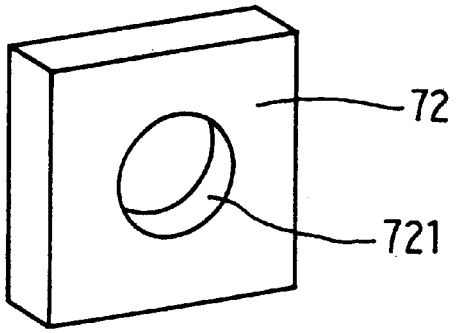
Figure 12:
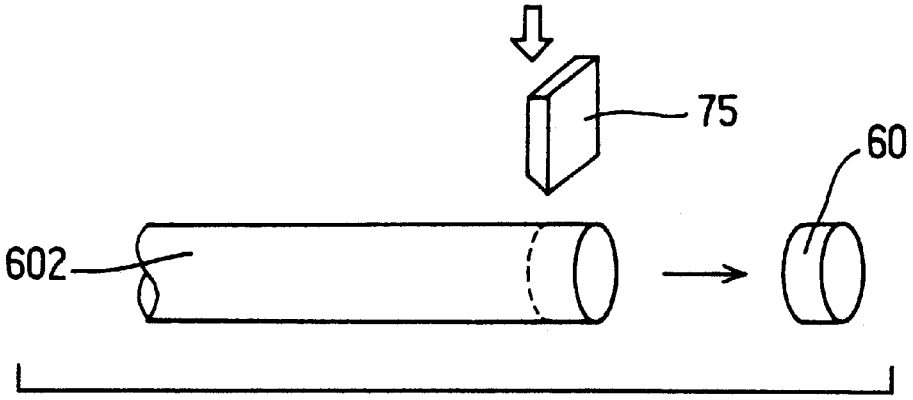
FIG. 12 is an explanatory view showing a cutting step in the method for forming the noble metal chip in the fifth embodiment.
Figure 13A:
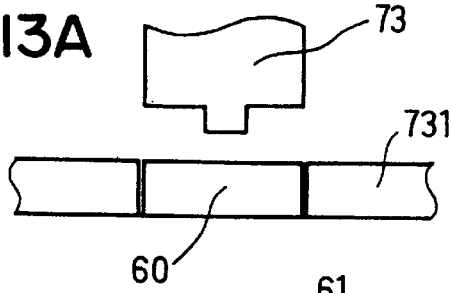
FIGS. 13A to 13C are explanatory views showing a step for forming a groove portion on the noble metal chip in the fifth embodiment.
Figure 13B:
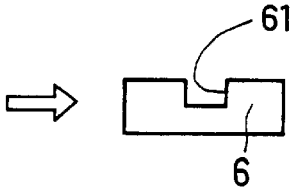
Figure 13C:
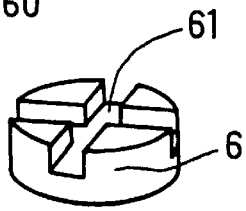

Then, a heat treatment is carried out on the rolled wire rod 601 at around recrystallization temperature. After that, as shown in FIGS. 11A and 11B, the rolled wire rod 601 is deformed by a drawing step using a drawing die 72 having a processing hole 721. Accordingly, a wire rod 602 having a predetermined diameter necessary for the noble metal chip 6 is formed. Subsequently, as shown in FIG. 12, the wire rod 602 is cut by a cutter 75 in the radial direction into a columnar piece 60. Then, as shown in FIGS. 13A and 13B, in a state where the columnar piece 60 is fixed by a jig 731, the cross-shaped groove 61 is formed by a header 73 on the columnar piece 60. As a result, as shown in FIG. 13C, the noble metal chip 6 having the cross-shaped groove 61 is obtained.

Next, effects in the fifth embodiment will be explained. The noble metal alloy is obtained by hot forging, and then is deformed by compressive force which is applied in the radial direction to the noble metal alloy by the warm groove rolls 70. As a result, the noble metal alloy is deformed into the wire rod having the decreased diameter. That is, the noble metal chip 6 is formed by being pressed in the radial direction thereof. Further, because the heat treatment after the rolling step is carried out at around the recrystallization temperature, the crystals of the rolled wire rod do not largely grow.

Figure 14A:
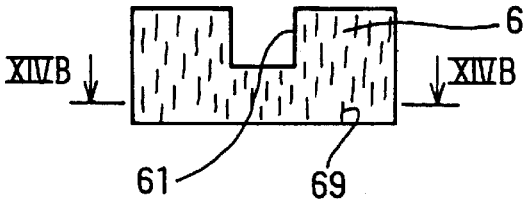
FIG. 14A is a cross-sectional view schematically showing a crystal grain structure of the noble metal chip in the fifth embodiment.
Figure 14B:
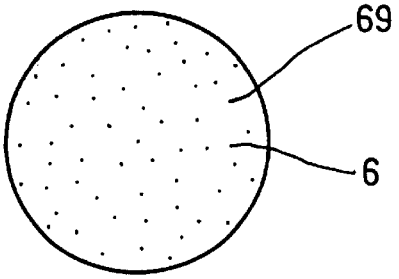
FIG. 14B is a cross-sectional view taken along a XIVB—XIVB line in FIG. 14A.

Therefore, the noble metal chip 6 formed by the above-described method has a crystal grain structure as shown in FIGS. 14A and 14B. Specifically, as described above, average grain diameters N $\mu$m, K $\mu$m satisfy the relationships of N>K and (N+K)/2≦50 $\mu$m.

In a conventional method for manufacturing a conventional noble metal chip, a noble metal alloy is rolled by rollers. Then, after a heat treatment is carried out, a piece having the same shape as that of the noble metal chip is stamped out from the rolled noble metal alloy using a press die and a punch. A groove portion is formed on the piece, so that the conventional noble metal chip is formed. The thus formed noble metal chip has crystal grains elongated in a radial direction thereof. Therefore, when the noble metal chip is made of a brittleness material such as Ir alloy, the noble metal chip is liable to have cracks therein to be separated from the central electrode. As a result, the spark plug life is shortened.

The cracks and separation of the noble metal chip can be caused mainly by thermal stress in the radial direction of the noble metal chip. The thermal stress is produced due to a thermal expansion difference between the noble metal chip and the electrode main material during the operation of the spark plug. Here, because the crystal grains constituting the conventional noble metal chip elongate in the radial direction of the noble metal chip, the strength and toughness of the conventional noble metal chip against the thermal stress in the radial direction is small. As opposed this, the crystal grains constituting the noble metal chip 6 in the fifth embodiment elongate in the axial direction of the chip and have average diameters N, K fulfilling the relationships of N>K and (N+K)/2≦50 $\mu$m. Therefore, the strength and toughness of the noble metal chip 6 against the thermal stress in the radial direction is improved, so that cracks and separation are prevented from occurring to the noble metal chip 6 during the operation of the spark plug 10. As a result, the spark plug life is lengthened.

In the fifth embodiment, although the groove portion 61 has a cross-shape, the plan shape and cross-sectional shape of the groove portion 61 can be arbitrarily changed into those shown in FIGS. 7A to 7D as in the second embodiment. Accordingly, the same effects as those in the first and second embodiments can be obtained.

Figure 15:
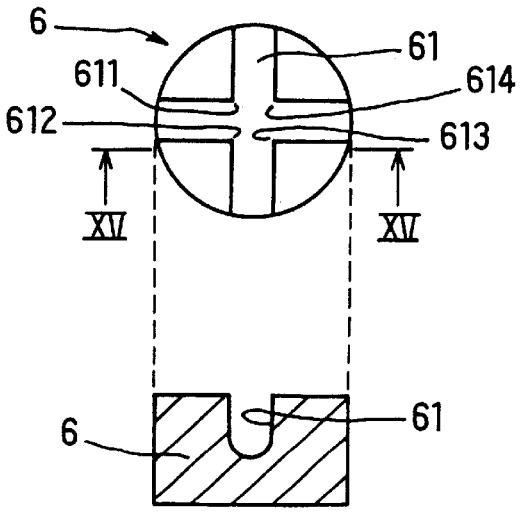
FIG. 15 is a diaphragm including a plan view showing a noble metal chip used for a evaluation test in the fifth embodiment and a cross-sectional view taken along a XV—XV line in the plan view.

The characteristics of the spark plug 10 in the fifth embodiment were examined by the following test. In the test, an engine having 2000 cc and 4 cylinders was used. The engine was operated alternatively at an idling state with an engine speed of 600 rpm for 6 minutes, and at a full load state with an engine speed of 5000 rpm for 6 minutes. This operation was repeatedly continued for 200 hours with 1000 cycles. As shown in FIG. 15, the noble metal chip 6 used in the test was composed of a columnar chip having a diameter of 2.6 mm and a height of 2 mm, and a cross-shaped groove portion 61 having a width of 0.4 mm and a depth of 0.7 mm was formed on the columnar chip. The bottom portion of the groove portion 61 had a U-shaped cross-section.

Then, three wire drawing samples and three rolling samples each having the same structure as that of the noble metal chip 6 described above were prepared. Each of the wire drawing samples and the rolling samples were formed to have crystal grains, values of (N+K)/2 of which were 30 $\mu$m, 50 $\mu$m, 70 $\mu$m, respectively. The wire drawing samples were formed by the above-described method in the fifth embodiment. On the other hand, the rolling samples were formed to have a specific diameter necessary for the noble metal chip by the rolling step using the warm groove rolls 70 shown in FIGS. 10A and 10B. The drawing step shown in FIGS. 11A and 11B was not performed on the rolling samples. The steps carried on the wire drawing samples and rolling samples before the rolling step were substantially the same.

Then, occurrence states of cracks at four corners 611, 612, 613, 614 (see FIG. 15) of the groove bottom portion of the respective samples were evaluated. As a result, concerning the wire drawing samples, the sample having the value of (N+K)/2 being 70 $\mu$m had one crack; however, the other samples having the values of (N+K)/2 being 30 $\mu$m and 50 $\mu$m had no cracks. Further, concerning the rolling samples, the sample having the value of (N+K)/2 being 70 $\mu$m had three crack; however, the other samples having the values of (N+K)/2 being 30 μm and 50 μm had only one crack, respectively. Accordingly, it is confirmed that when the value of (N+K)/2 is equal to or less than 50 μm and the relationship of N>K holds, the strength of the noble metal chip is improved. Incidentally, if the value of (N+K)/2 of the noble metal chip 6 exceeds 50 μm, a crack produced in the noble metal chip 6 can easily progresses therein.

Next, substantially the same evaluation test as described above was carried out on six types of spark plugs respectively including various noble metal chips. As shown in FIG. 16, three of the noble metal chips indicated by reference numeral 6*a* have grains 69 elongated in the axial direction thereof according to the present invention, and the other three of the noble metal chips indicated by reference numeral 9 have grains 98 elongated in the radial direction thereof as conventional ones. The diameters of each three noble metal chips 6*a*, 9 were 1.0 mm, 1.5 mm, and 2.0 mm, respectively. The noble metal chips 6*a*, 9 were formed from the same material to have grains with an average diameter of 50 μm. The noble metal chips 6*a*, 9 were columnar and did not have any groove portions thereon. Then, the occurrence states of cracks to the noble metal chips 6*a*, 9 were evaluated substantially in the same manner as described above.

As a result, as shown in FIG. 16, the conventional noble metal chips 9 having 1.5 mm and 2.0 mm diameters had cracks elongated in the radial direction at positions adjacent to the bonding face with the electrode main material 20. Especially the cracks produced in the noble metal chip 9 having 2.0 mm diameter were very large and were going to cause the separation of the noble metal chip 9. This is because the larger the diameter of the noble metal chip becomes, the larger the thermal expansion difference between the noble metal chip and the electrode main material becomes.

As opposed to this, concerning the noble metal chips 6*a* of the present invention, the noble metal chip 6*a* having 1.5 mm diameter had minute cracks 8 elongated in the axial direction from the bonding face with the electrode main material 20. The noble metal chip 6*a* having 2.0 mm diameter only had only a few minute cracks 8 elongated in the axial direction from the bonding face. The noble metal chips 6*a*, 9 having 1.0 mm diameter did not have any cracks therein. The cracks 8 produced in the noble metal chips 6*a* were very small and elongated in the axial direction. Therefore, the cracks 8 cannot cause separation of the noble metal chip 6*a* from the electrode main material 20. Incidentally, in FIG. 16, marks ○, Δ, X of evaluation mean that there are few cracks or no cracks, there are several cracks, and there are several large cracks, respectively.

According to this evaluation test, the following points are founded. That is, when the noble metal chip 9 including grains elongated in the radial direction has a diameter larger than 1.5 mm, the effect by thermal stress becomes large to produce cracks in the noble metal chip 9. As opposed to this, in the noble metal chip 6*a* including grains elongated in the axial direction, even when the diameter of the noble metal chip 6*a* is 2.0 mm, the noble metal chip 6*a* is hardly affected by the thermal stress. Therefore, the noble metal chip 6*a* of the present invention fulfilling the relationship of N>K hardly has cracks therein capable of causing the separation thereof even when the diameter of the noble metal chip 6*a* is 2.0 mm.

The spark plug is required to includes a noble metal chip having 1.5 mm diameter or more, preferably 2.0 mm diameter or more in order to prevent wastage of the noble metal chip by spark discharge, and the noble metal chip of the present invention can comply with this requirement. Also in this embodiment, preferably, the noble metal chip is made of Ir or Ir alloy having a high melting point. More preferably, the noble metal chip is made of Ir alloy including at least one of Pt, Pd, Rh, Ru, and Ni. Accordingly, the wastage of the noble metal chip is further suppressed, resulting in long life of the spark plug.

It is apparent that the first to fifth embodiments can be arbitrarily combined to exhibit the effects described above. While the present invention has been shown and described with reference to the foregoing preferred embodiments, it will be apparent to those skilled in the art that changes in form and detail may be made therein without departing from the scope of the invention as defined in the appended claims.

What is claimed is:

1. A spark plug comprising:

an insulator having a through hole extending therein;

a central electrode disposed in the through hole;

a housing holding the insulator therein; and an earth electrode fixed to the housing and facing the central electrode to define a spark gap G therebetween within a range of 0.2 mm≦G<0.4 mm, wherein a gap space which is larger than a sphere having a diameter equal to or larger than 0.4 mm is provided in the spark gap G.

2. The spark plug of claim 1, further comprising a noble metal chip disposed on one of the central electrode and the earth electrode to face another one of the central electrode and the earth electrode with the spark gap G.

3. The spark plug of claim 2, wherein:

the noble metal chip has a groove thereon for forming the gap space.

4. The spark plug of claim 3, wherein:

the noble metal chip has a diameter D in a range of 1.5 mm<D≦3.5 mm; and the groove has a depth H in a range of H>0.4−G, a width W in a range of $W>\{4\times G(0.4-G)\}^{1/2}$.

5. The spark plug of claim 3, wherein the groove has a shape selected from a group consisting of a cross-shape, an I-like shape, a Y-like shape, and a curve-like shape.

6. The spark plug of claim 2, wherein the noble metal chip includes at least one of Ir and Ir alloy.

7. The spark plug of claim 2, wherein the noble metal chip is made of Ir alloy including at least one selected from a group consisting of Pt, Pd, Rh, Ru, and Ni.

8. The spark plug of claim 2, wherein the noble metal chip has a concave portion defined thereon for forming the gap space.

9. The spark plug of claim 2, wherein the noble metal chip is columnar, and has a plurality of crystal grains having an average grain diameter N μm in an axial direction and an average grain diameter K μm in a radial direction, the average grain diameter N being larger than the average grain diameter K.

10. The spark plug of claim 9, wherein the average grain diameters N and K fulfill a relationship of (N+K)/2≦50 μm.

11. The spark plug of claim 2, wherein the noble metal chip has a recessed portion formed in a surface thereof for defining a portion of the space.

12. The spark plug of claim 11, wherein the recessed portion comprises a groove.

13. The spark plug of claim 12, wherein a cross-sectional bottom shape of said groove is one of a V-shape and a U-shape.

14. The spark plug of claim 11, wherein the recessed portion comprises a concave portion.

15. The spark plug of claim 14, wherein said concave portion comprises an axial bore extending to a partial depth of said noble metal chip.

16. The spark plug of claim 15, wherein a base of said concave portion has a cross-sectional shape that is one of a V-shape and a U-shape.

17. The spark plug of claim 11, wherein a plurality of longitudinally extending protrusions are defined on the noble metal chip, said recessed portion comprising a groove defined by spaces between said plurality of protrusions.

18. The spark plug of claim 17, wherein there are three generally cylindrical protrusions.

19. The spark plug of claim 1, wherein:

the central electrode has a front face facing the earth electrode and having a diameter D in a range of 1.5 mm<D≦3.5 mm; and a groove is formed on the front face of the central electrode to have a depth H in a range of H>0.4−G, and a width W in a range of $W>\{4\times G(0.4-G)\}^{1/2}$.

20. The spark plug of claim 19, wherein the groove has a shape selected from a group consisting of a cross-shape, an I-like shape, a Y-like shape, and a curve-like shape.

21. A spark plug comprising:

an insulator having a through hole extending therein;

a central electrode disposed in the through hole;

a housing holding the insulator therein;

an earth electrode fixed to the housing and facing the central electrode to define a spark gap therebetween; and a noble metal chip bonded to one of the central electrode and the earth electrode to have a front face facing another one of the central electrode and the earth electrode with the spark gap, the noble metal chip including a plurality of crystal grains, the plurality of crystal grains having an average grain diameter N $\mu$m in an axial direction of the noble metal chip and an average grain diameter K $\mu$m in a radial direction of the noble metal chip, the average grain diameters N and K fulfilling relationships of N>K and (N+K)/2≦50 $\mu$m.

22. The spark plug of claim 21, wherein the noble metal chip has a groove on the front face.

23. The spark plug of claim 22, wherein the groove has a shape selected from a group consisting of a cross-shape, an I-like shape, and Y-like shape, and a curve-like shape.

24. The spark plug of claim 21, wherein a diameter of the noble metal chip is equal to or larger than 1.5 mm.

25. The spark plug of claim 21, wherein the noble metal chip includes at least one of Ir and Ir alloy.

26. The spark plug of claim 21, wherein the noble metal chip is made of Ir alloy including at least one selected from a group consisting of Pt, Pd, Rh, Ru, and Ni.

27. The spark plug of claim 21, wherein the noble metal chip is formed by reducing a diameter thereof by a compressive stress applied in the axial direction.

28. A spark plug comprising an insulator having a through hole, a central electrode disposed in the through hole, a housing holding the insulator, an earth electrode fixed to the housing to define a spark gap therebetween, and a columnar noble metal chip disposed on one of the central electrode and the earth electrode in the spark gap, the columnar noble metal chip formed by steps of:

preparing a noble metal base member;

deforming the noble metal base member to be a wire rod while applying a compressive stress in a radial direction of the wire rod so the wire rod has a specific diameter equal to a diameter of the columnar noble metal chip; and cutting the wire rod in the radial direction to form the columnar metallic chip having a plurality of crystal grains elongated in an axial direction thereof.

29. The spark plug of claim 28, wherein the plurality of crystal grains has a first average grain diameter N am in the axial direction of the columnar noble metal chip and a second average grain diameter K am in the radial direction of the columnar noble metal chip, the first and second average grain diameters N and K fulfilling relationships of N>K and (N+K)/2≦50 $\mu$m.

* * * * *